United States Patent [19]

Hallford

[11] 4,302,739

[45] Nov. 24, 1981

[54] BALUN FILTER APPARATUS

[75] Inventor: Ben R. Hallford, Wylie, Tex.

[73] Assignee: Rockwell International Corporation, El Segundo, Calif.

[21] Appl. No.: 84,286

[22] Filed: Oct. 12, 1979

[51] Int. Cl.[3] ..... H01P 1/203; H01P 5/10

[52] U.S. Cl. ..... 333/204; 333/26; 333/246

[58] Field of Search ..... 333/245, 246, 25, 26, 333/167–168, 169–171, 176–180, 202, 204, 206–207

[56] References Cited

U.S. PATENT DOCUMENTS

| | | | |
|---|---|---|---|
| 2,266,501 | 12/1941 | Lindenblad | 333/206 |
| 2,368,694 | 2/1945 | Watts, Jr. | 333/26 |
| 3,571,722 | 3/1971 | Vendelin | 333/25 X |
| 4,193,048 | 3/1980 | Nyhus | 333/246 |

OTHER PUBLICATIONS

Bawer et al., "A Printed Circuit Balun for Use with Spiral Antennas", Ire Trans. on *Microwave Theory and Techniques,* May 1960, pp. 319–325.

*Primary Examiner*—Marvin L. Nussbaum
*Attorney, Agent, or Firm*—Bruce C. Lutz; Howard R. Greenberg; H. Fredrick Hamann

[57] ABSTRACT

The present invention uses two interconnected baluns with the balanced output of one feeding a balanced input of the other. When this filter is used in conjunction with a signal frequency converter, the balun pair not only provides extremely effective bandpass filtering so as to pass the RF frequencies and not the IF frequencies but, in addition, provides a condition which appears to the IF as a nearly open circuit and thus provides a large amount of reflection or return of the IF signals to the signal converter so that the overall signal converter operation is more efficient in combination with the present invention than with any comparable known prior art signal isolating device.

10 Claims, 5 Drawing Figures

BALUN FILTER APPARATUS

THE INVENTION

The present invention is generally concerned with electronics and more specifically concerned with signal isolation and/or bandpass filtering.

When designing mixers or signal converters for use at any frequency and especially for use in conjunction with radio frequencies in the low GHz range, it is desirable to prevent a loss of IF signal frequencies used in the converter. The term "mixer" as used herein includes all frequency translators or converters whether they use sum or difference frequency products in the output.

The need always exists to separate an IF frequency signal from RF frequency signals at some point in the converter with a minimum of disturbance. The present inventive concept was constructed to separate IF signals in the approximately 100 MHz range from RF frequencies in the 5 GHz range. A series capacitor in the microstrip line is a usual prior art method employed, but this does not provide a high value of isolation unless the IF and RF signals are widely separated in frequency. In communication systems, the leakage of modulated IF signals from a mixer into adjoining circuits may cause the IF signal to be eventually reflected back to the mixer with a phase delay which causes a level of echo distortion that depends on the delay and magnitude of the returned IF signal. When such IF signals are allowed to escape from the signal converter proper, they are effectively lost and the efficiency of the signal converter is reduced.

It has been found that three grounded quarter-wavelength stubs spaced at quarter-wavelength spans at the RF frequency on a line between an RF signal generator and a signal converter provides very good IF bandpass filtering and, in fact, the bandpass filtering obtained is comparable to that obtained by the present invention. However, such a grounded stub configuration effectively shorts all applied IF signals to ground and thus provides for very low efficiency of the signal converter.

The present idea was based on the inventive concept that two single baluns could be used back to back so as to pass (provide high coupling efficiency to) the RF frequency signals and reject (provide poor coupling to) the IF signals. A DC block would also be obtained with such a circuit and would not require additional components to be added for this purpose.

As mentioned supra, the normal prior art approach to signal isolation has been to use a small capacitor in series between the signal converter and the RF generator. While such a capacitor does produce some reflection of the IF signal and is certainly better than using quarter-wavelength stubs to ground, there is not adequate isolation in the IF signal. In addition, the IF frequency signal must be very widely separated from the RF frequency signal in order to produce adequate attenuation of the IF frequency signals being passed through the capacitor and thus being received by the RF generator. In a typical prior art signal converter, the RF frequencies utilized may be in the order of 5 gigahertz with the IF frequency signal being at 100 megahertz. In such a condition, the attenuation of the IF signal power through the filter is decreased to a level of approximately 1 to 316 or 25 dB. It is considered desirable in some wideband receiver applications to have the IF frequency as close as possible to the RF frequency so as to prevent reception of image frequency signals that may be present in the receiver bandpass. The present inventive concept utilizes a planar balun wherein the signal coupling strips are one quarter-wavelength with respect to the signal being passed or in other words, the RF signal frequency. The IF frequency signals do not readily couple from the primary transmission path to the quarter-wavelength paths and thus the IF frequency signals effectively see an open circuit. However, it is undesirable to operate in a balanced condition with planar RF circuit technology and thus in a preferred embodiment another balun is used to return the signal to an unbalanced output condition. While the theory behind the use of two baluns is not completely understood, it is probable that there is interaction between the two baluns and that the operation of the two baluns in series provides a total isolation greater than the sum of the parts. In any event, the signal rejection is very similar to that obtained by 3 grounded quarter-wavelength stubs spaced at quarter-wavelengths along the signal transmission path (which stubs disadvantageously have a low IF impedance to ground). However, the shunt IF impedance to ground is similar to that of the commonly used series capacitor (which does not have as high a signal rejection or signal isolation). As compared to the series capacitor, the present invention has more than 300 times the signal power isolation using the RF and IF signal frequencies of the prior art. However, the result of the present invention is to allow the IF frequency to be raised by almost an order of magnitude while maintaining a given attenuation of IF signals in approaching the frequency of the RF signal over that of the prior art.

While the preferred embodiment uses two baluns, a single balun will operate as a filter in accordance with the teachings infra.

In accordance with the above comments, it is believed apparent that an object of the present invention is to provide improved signal filtering and signal isolating apparatus.

Other objects and advantages of the present invention will be apparent from a reading of the specification and appended claims in conjunction with the drawings wherein:

Figure 3:
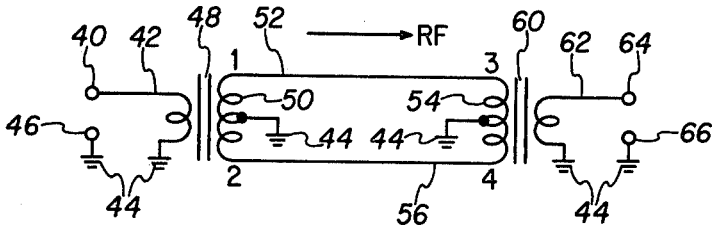
Figure 4:
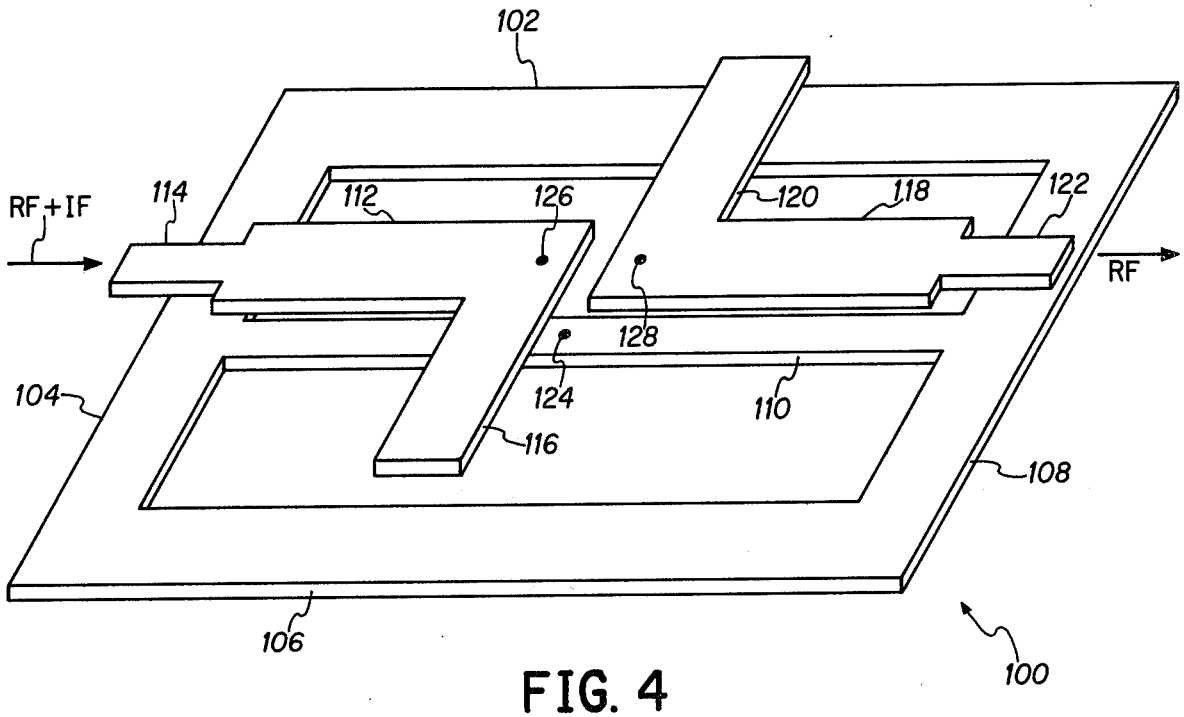

FIG. 3 comprises an equivalent circuit representation of the present invention;

FIG. 4 is a second embodiment of the inventive concept; and

Figure 5:
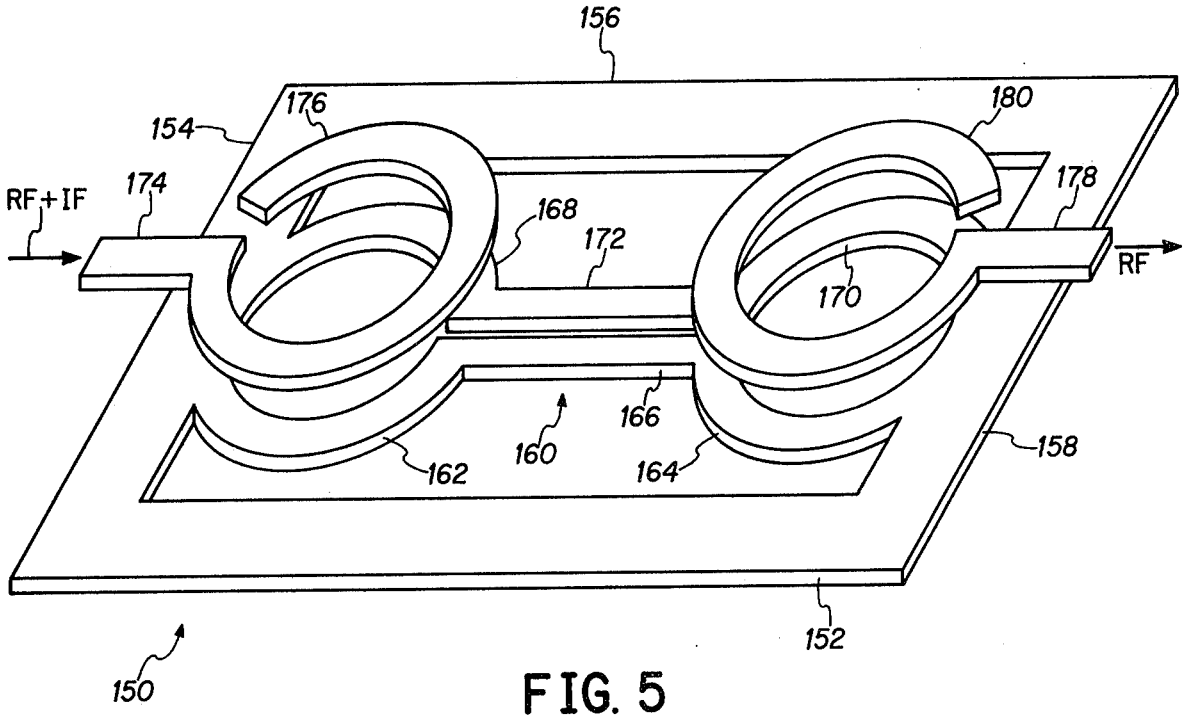

FIG. 5 is a further embodiment of the inventive concept.

DETAILED DESCRIPTION

Figure 1:
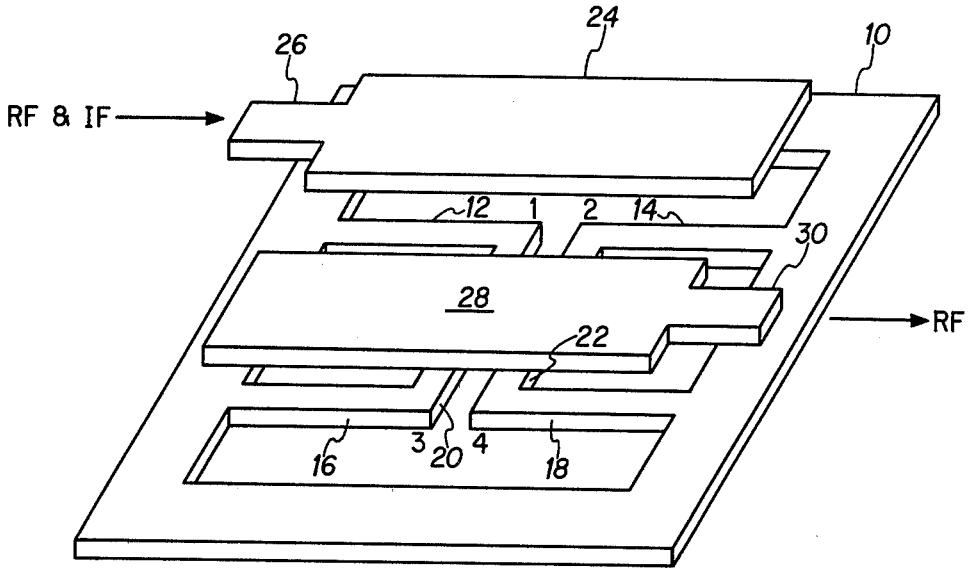
FIG. 1 is an isometric pictorial concept of the present invention.

In FIG. 1 a ground plane 10 is illustrated having a plurality of transmission paths 12, 14, 16 and 18 extending therefrom. Paths 12 and 16 are joined by a conductor 20 while paths 14 and 18 are joined by a conductor 22. The intersection of transmission path 12 and conductor 20 is additionally labeled with the numeral 1 and is adjacent a similar junction labeled 2 between transmission path 14 and conductor 22. As illustrated, the transmission paths 16 and 18 have similar points additionally labeled 3 and 4. Juxtaposed but spaced from the transmission paths 12 and 14 is a coacting transmission path 24 which has an input portion 26. Juxtaposed and spaced from transmission paths 16 and 18 is a further coacting transmission path 28 having a signal terminal 30.

While a practical embodiment of the invention would contain a quantity of dielectric such as printed circuit board material between the transmission paths 24 and 28 and the remaining transmission paths and ground plane, the present illustration was utilized to provide a clearer understanding of the inventive concept.

Figure 2:
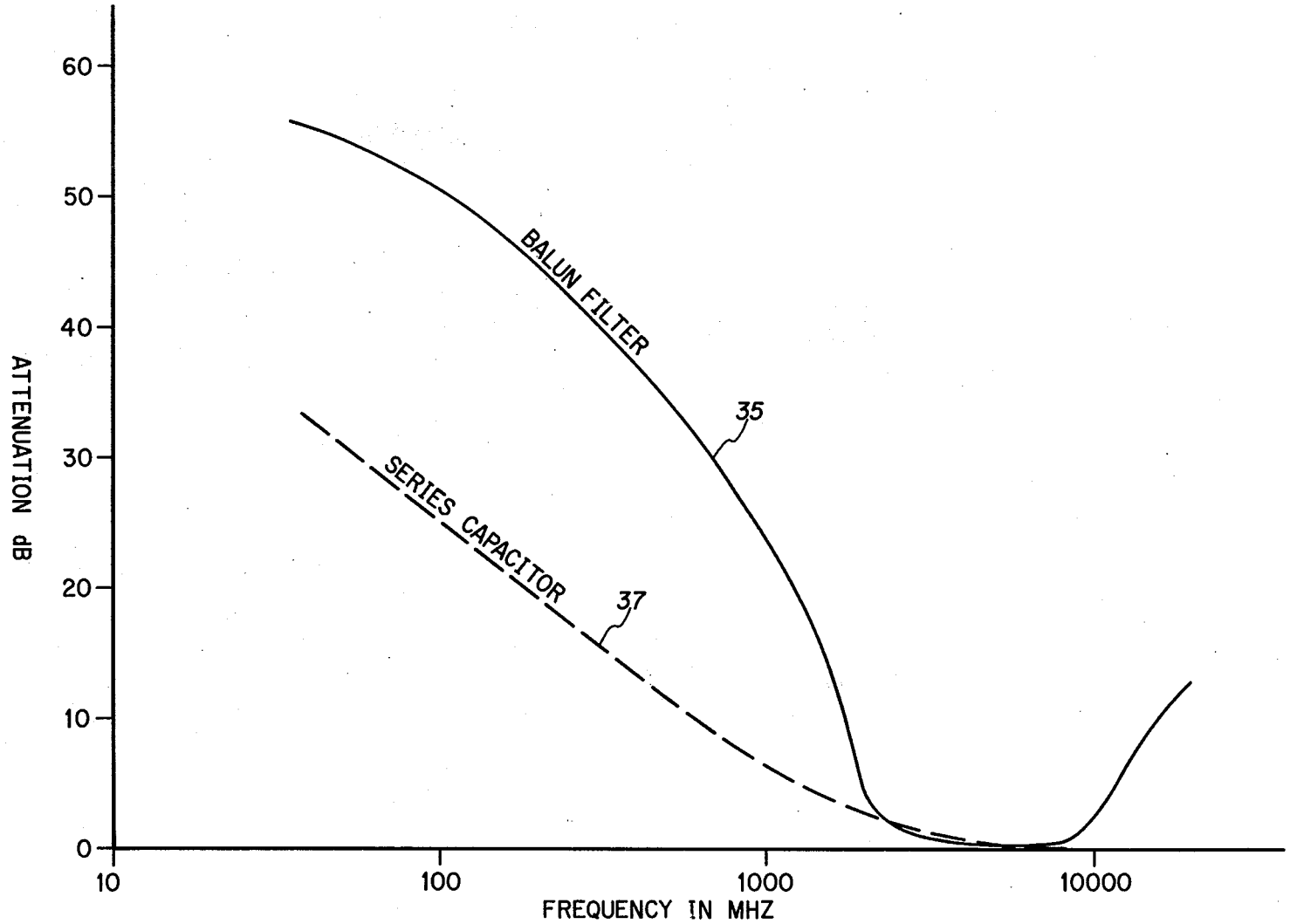
FIG. 2 is a set of attenuation waveforms illustrating the attenuation versus frequency for the prior art signal isolation apparatus commonly used and for the present invention.

FIG. 2 is a graph having the vertical or Y axis labeled in dB which is a logarithmic representation of power. The horizontal axis is also logarithmetic and provides an indication of frequency. A first curve 35 illustrates the amount of loss of given frequency signals through the present inventive balun filter for a range of frequencies. Curve 37 provides an indication of the same information for a series capacitor used as a filter. Both of these components may be usable in frequency converters and in particular in a frequency converter using stripline or microstrip techniques. As illustrated in FIG. 2, at 100 MHz a capacitor provides approximately 25 dB of attenuation in a given 1.8 picofarad series circuit connection while a balun filter designed in accordance with the present inventive concept provides 50 dB. A typical operating frequency for frequency converters utilizing the present invention might be in the neighborhood of 5 gigahertz (5000 megahertz). At such frequencies the attenuation of either the balun filter or the series capacitor is in the neighborhood of 0.5 dB. Thus, it will be readily apparent that a balun filter provides much greater attenuation for any frequencies below the RF design frequency of the device.

In FIG. 3, an input terminal 40 supplies signals to a primary winding 42 connected to ground 44. Input signals have to be referenced to ground and thus a second input terminal 46 is also connected to ground 44. The primary winding 42 acts through coupling means 48 to provide signals on a secondary winding 50 having ends 1 and 2 corresponding to those identical points in FIG. 1 and having a center tap connected to ground 44. As will be realized by those skilled in the art, equivalent circuits for planar baluns use parallel lines to group related windings and are not interpretable as an equivalent to an iron core transformer. Lead 1 of winding 50 is connected via a lead 52 to a lead 3 of a secondary winding 54. Lead 2 of winding 50 is connected via a lead 56 to lead 4 of winding 54. A ground 44 is illustrated connected to the center tap of winding 54. Winding 54 acts through coupling means 60 with winding 62 to provide an output between terminal 64 and terminal 66. Terminal 66 is connected to ground 44 as is the other end of winding 62.

FIG. 3 is an electrical schematic equivalent of FIG. 1. The leads 52 and 56 are illustrated in FIG. 1 as conductive paths 20 and 22 respectively. From the above, it will be realized that coupling means 48 and 60 in FIG. 1 would normally be considered the air spacing or dielectric spacing between the transmission paths (primary windings) such as 24 and 28, and the secondaries which comprise the transmission paths are 12 and 14 in one case and 16 and 18 in the second case.

In FIG. 4 a ground plane generally designated as 100 has four sides 102, 104, 106 and 108 as illustrated. A further conductive element or transmission path 110 extends from ground plane portion 104 to ground plane portion 108. A first balun primary element or transmission means 112 is illustrated with an input terminal 114 and a grounding stub 116. The portion 112 is substantially equal to $\frac{1}{4}$ the length of the wavelength of the frequency of the signal to be passed from input to output of the isolation device illustrated in FIG. 4. The stub 116 may be various lengths but generally will be electrically equivalent to $\frac{1}{4}$ the same signal wavelength whether it is accomplished through total length of element 116 or its length as it coacts with adjacent ground plane material such as 106. The second balun comprises the remaining portion of conductor 110 as well as a further coupling means or transmission element 118, a further grounding stub 120 and an output terminal 122. Although not designed as such, balanced outputs could be obtained between the common point 124 on conductor 110 and either the points 126 or 128 on quarter-wavelength transmission coupling means 112 or 118 respectively.

As previously indicated, FIG. 5 is a further embodiment of the inventive concept wherein a ground plane is generally designated as 150 with portions 152, 154, 156 and 158. A first conductor or signal coupling means generally designated as 160 has two arc portions 162 and 164 and a relatively straight interconnecting conductor 166. Two further arc portions 168 and 170 form a similar pattern with a further interconnecting conductor 172. Signals may be input between a primary balun input member designated as 174 and ground plane 154 and are transmitted to an arc 176 forming a nearly complete circle which coacts with both the arc portions 162 and 168. An output transmission coupling means having an output terminal 178 has an arc path 180 which coacts with the coupling elements 164 and 170. If so desired, a balanced output could be obtained at some point between the conductor elements 166 and 172. The length of each of the elements 162, 164, 168 and 170 would each be a length corresponding to $\frac{1}{4}$ the wavelength of the frequency of signals to be passed with optimum coupling for the areas where it coacts with the conductor juxtaposed thereto.

OPERATION

As is known to those skilled in the art, a balun is a term used as an abbreviation for a "balanced to unbalanced" converter or vice versa. In using the device as a bandpass filter to pass only RF signals and not IF signals, it may be assumed that the RF signals for the example shown are in the neighborhood of 5 gigahertz while the IF signals are below 1000 megahertz. The RF signals in being applied to transmission line 24 of FIG. 1 will readily couple to the transmission paths 12 and 14 each of which are $\frac{1}{4}$ wavelength relative to a 5 gigahertz signal. These signals are then passed via conductive paths 20 and 22 to the $\frac{1}{4}$ wavelength transmission paths 16 and 18 where they are coupled to transmission path 28 and output on terminal 30 relative to ground plane 10. The IF signals on the other hand are loosely coupled between transmission path 24 and the transmission paths 12 and 14 and again couple very poorly between transmission paths 16 and 18 and the output transmission path 28. Thus, very little of the applied IF signals are transferred from input 26 to output 30.

While the present device is very usable as a bandpass filter, it is also usable as an isolation device. As an isolation device, it will be noted that any low frequency signals which are applied to terminal 26 effectively "see" a nearly open circuit. This open circuit presents a high IF signal shunt impedance to ground and a high series circuit impedance and thus minimizes IF signal loss from a source such as a signal frequency converter (mixer) and enhances the efficiency of the mixer circuit. If a shunt type filter, as mentioned previously were used, the attenuation of the IF signals would follow a curve similar to that of curve 35 in FIG. 2; however, the IF signals are lost to ground and the efficiency of the mixer circuit is so low as to be nonusable.

As is known to those skilled in the art, the width of the transmission line elements has an affect on the capacitance to ground and to unit inductance and thus affects the input impedance as seen by connected sources and loads. Thus, while the width of the transmission lines 24 and 28 are wider than the associated coupling lines 12 through 18, this relative difference in widths is a design choice and there may be instances where the transmission lines 24 and 28 are of a narrower width than the associated coupling paths.

The embodiment of FIG. 4 utilizes a common secondary line 110 as the main coupling element to two separated primary signal transmission means 112 and 118. The stub 116 along with element 112 provide a total of $\frac{1}{2}$ wavelength to the incoming RF signal whereby the signal source views the proper impedance. However, only $\frac{1}{4}$ of this wavelength is used to couple to the associated conductor 110. As before, the quarter-wavelength coupling discourages the transmission of IF signals or any other undesired or unwanted signals and this transmission of IF signals is again discouraged in coupling between element 110 and 118. Although the length of the stubs 116 and 120 is illustrated as extending slightly over the ground plane, and is designed such that it is approximately $\frac{1}{4}$ wavelength long, these can be shortened and the ground plane extended to influence the associated stub whereby the extra capacitance between the stub and the ground plane represents a more desirable impedance to the RF signal. Thus, the width of the total element can be minimized. It will be realized, however, that the width of this isolation device is considerably less than that of FIG. 1 and represents substantially the same length. Therefore, the apparatus of FIG. 1, in certain embodiments, will provide a more compact packaging. However, while the embodiment of FIG. 1 can have the two ports such as input and output appearing on the same "side" of the device, the embodiment of FIG. 4 of necessity requires that they be on opposite sides of the device.

Although the embodiment of FIG. 4 is more compact than that of FIG. 1, it does allow coupling between the ends of elements 112 and 118 whereby the balun filtering action or isolation action is effectively reduced. Thus, for certain applications of the invention, the compact features of the FIG. 4 embodiment may not be a significant factor in selection of coupling element design for the baluns of the present device.

FIG. 5 is substantially self-explanatory after observing FIG. 1 and understanding its operation and thus it will not be expanded upon except to comment that it is another attempt at optimizing space available by obtaining the quarter-wavelength in a curved fashion to reduce both the length and the width from that required by the version of FIG. 1.

While the inventive concept is illustrated using two baluns wherein there is signal coupling between a first transmission path and a pair of secondary transmission paths in combination with an identical unit, the inventive concept is believed to be usable using a single balun as a filter or isolation device. However, the present inventor has not had a need for an unbalanced filter to date.

It is thus believed that the present inventive concept is applicable wherever two baluns are connected together as a filtering or isolation device as long as the design of the baluns is such that there is no direct current (ohmic connection) between the primary and secondary portions of the input and output terminals.

I wish therefore to be limited only by the scope of the appended claims rather than to the specific embodiments discussed. Thus, I wish to include all appropriate modifications, such as changing the terminal leads 26 and 30 to be on the same side of the balun, which fall within the scope of the appended claims wherein I claim.

I claim:

1. Filter apparatus comprising, in combination:

ground plane means;

first and second signal transmission means extending from said ground plane means toward a first common area;

third and fourth signal transmission means extending from said ground plane means toward a second common area;

first conductive path means for electrically connecting said first signal transmission means in said first common area to said third signal transmission means in said second common area;

second conductive path means for electrically connecting said second signal transmission means in said first common area to said fourth signal transmission means in said second common area;

signal input means juxtaposed said first and second signal transmission means for signal coaction therewith; and signal output means juxtaposed said third and fourth signal transmission for signal coaction therewith.

2. Bandpass filter apparatus comprising, in combination:

unbalanced to balanced first signal translation means for passing only a band of signal frequencies;

balanced to unbalanced second signal translation means for passing only said band of signal frequencies;

input means for applying signals both inside and outside the bandpass frequencies to the unbalanced portion of said first signal translation means; and conductive means connecting the balanced portions of said first and second signal translation means together.

3. Apparatus as claimed in claim 2, wherein said filter apparatus is a bandpass filter for RF signal frequencies and wherein:

said first signal translation means comprises balanced stubs which are of a length equal to $\frac{1}{4}$ the wavelength of said RF signal frequencies.

4. Filtering apparatus for passing a first frequency signal and attenuating passage of other frequency signals comprising, in combination;

first balun means including input means and output means;

second balun means including input means and output means; and means directly connecting said output means of said first balun means to said input means of said second balun means.

5. The method of isolating a given signal source from a further signal source comprising the steps of:

coupling a first frequency band of signals centering around a frequency $f_R$ through a first balun having a plurality of $f_R/4$ coupling stubs while rejecting signals outside the frequency range of said first frequency band, where $f_R/4$ represents a length equivalent to $\frac{1}{4}$ a wavelength at the frequency $f_R$, to obtain a second band of coupled output signals including the frequency $f_R$; and coupling said second frequency band of signals through a second balun having a plurality of $f_R/4$ coupling stubs while rejecting signals outside the frequency range of said second band of output signals.

6. Apparatus for bandpassing signals in a first range of frequencies while rejecting signals in a second range of frequencies comprising, in combination:

first and second balun means each including means for coupling signals in said first range of frequencies through each of said baluns and each including coupling stubs of substantially $\frac{1}{4}$ the length of the wavelength of said first range of frequencies; and said first and second balun means each including means for rejecting signals in said second range of frequencies within each of said baluns.

7. Signal isolation apparatus for passing a range of frequencies $\Delta f$ with minimal attenuation while significantly attenuating signal frequencies outside said range comprising, in combination:

input signal first balun means including first and second signal transmission coupling means;

output signal second balun means, separate from said first balun means, including first and second signal transmission coupling means; and means connecting said second signal transmission coupling means of said first balun means to said second signal transmission coupling means of said second balun means.

8. Apparatus as claimed in claim 7 wherein:

said first signal transmission coupling means fo each of said first and second balun means is substantially equivalent in length to $\frac{1}{2}$ the wavelength of signals in the range of frequencies $\Delta f$; and said second signal transmission coupling means of each of said first and second balun means is substantially equivalent in length to $\frac{1}{4}$ the wavelength of signals in the range of frequencies $\Delta f$.

9. Apparatus as claimed in claim 7 wherein:

one of said first and second signal transmission coupling means is electrically equivalent to $\frac{1}{4}$ the wavelength of a frequency within said $\Delta f$ range; and the other of said first and second signal transmission coupling means is electrically equivalent to $\frac{1}{2}$ the wavelength of a frequency within said $\Delta f$ range.

10. The method of bandpassing signals in a first range of frequencies while rejecting signals in a second range of frequencies comprising, the steps of:

coupling signals in a first range of frequencies through a first balun means having coupling stubs of substantially $\frac{1}{4}$ the length of the average wavelength of said first range of frequencies;

subsequently passing signals output by said first balun means through a second balun means having coupling stubs of substantially $\frac{1}{4}$ the average length of the wavelength of said first range of frequencies; and rejecting signals in said second range of frequencies from passing through each of said first and second baluns.

* * * * *